US012428185B1

(12) United States Patent
Ohlson, Jr.

(10) Patent No.: US 12,428,185 B1
(45) Date of Patent: Sep. 30, 2025

(54) FOOD PRODUCT PACKING APPARATUS, SYSTEM, AND METHODS THEREOF

(71) Applicant: Powell Systems Integration, Stoughton, MA (US)

(72) Inventor: John Ohlson, Jr., Miami, FL (US)

(73) Assignee: Powell Systems Integration, Stoughton, MA (US)

( * ) Notice: Subject to any disclaimer, the term of this patent is extended or adjusted under 35 U.S.C. 154(b) by 0 days.

(21) Appl. No.: 19/068,951

(22) Filed: Mar. 3, 2025

(51) Int. Cl.

| | |
|---|---|
| ***B65B 35/14*** | (2006.01) |
| ***B65B 25/00*** | (2006.01) |
| ***B65B 35/56*** | (2006.01) |
| ***B65B 39/00*** | (2006.01) |

(52) U.S. Cl.
CPC ..... *B65B 39/001* (2013.01); *B65B 25/001* (2013.01); *B65B 35/14* (2013.01); *B65B 35/56* (2013.01); *B65B 39/007* (2013.01)

(58) Field of Classification Search
CPC ... B65B 39/001; B65B 39/007; B65B 25/001; B65B 35/14; B65B 35/56
See application file for complete search history.

(56) References Cited

U.S. PATENT DOCUMENTS 4,019,547 A * 4/1977 Ross ..... B65B 39/00 141/81
4,514,959 A * 5/1985 Shroyer ..... G01G 13/241 221/172
4,718,217 A * 1/1988 Ross ..... B65B 9/2028 53/529
4,825,623 A * 5/1989 Ross ..... B65B 9/213 53/437
5,125,213 A * 6/1992 Focke ..... B65B 1/22 53/437
5,473,866 A * 12/1995 Maglecic ..... B65B 1/32 53/511
6,196,278 B1 * 3/2001 Wegman ..... G01F 13/006 141/286
8,132,394 B2 * 3/2012 Koike ..... B65B 9/213 53/551
9,309,013 B2 * 4/2016 Elias ..... B65D 77/003
10,723,492 B2 * 7/2020 Kieselhorst ..... B65B 39/12
2007/0227618 A1 * 10/2007 Simonsen ..... F26B 25/002 141/78
2011/0206812 A1 * 8/2011 Elias ..... B65B 7/28 53/111 R (Continued)

FOREIGN PATENT DOCUMENTS

CN 208647174 U 3/2019
CN 217170999 U 8/2022

*Primary Examiner* — Nicolas A Arnett
(74) *Attorney, Agent, or Firm* — Foley & Lardner LLP

(57) ABSTRACT

A packing apparatus includes a funnel including a top to receive a food product and a bottom, where a diameter of a bottom of the funnel is less than a length of the food product to orient the food product from the bottom of the funnel in a packing orientation. The packing apparatus further includes a tube connected to the bottom of the funnel, where a length of the tube is greater than or equal to half the length of the food product. The packing apparatus further includes a gate assembly connected to a bottom of the funneling assembly, where the gate assembly releases the food product in the packing orientation from an outlet of the tube.

20 Claims, 4 Drawing Sheets

(56) References Cited

U.S. PATENT DOCUMENTS

| | | | | |
|---|---|---|---|---|
| 2011/0239595 | A1* | 10/2011 | Jones | B65B 61/20 53/473 |
| 2013/0118638 | A1* | 5/2013 | Hopkins | A61J 3/074 141/234 |
| 2015/0336687 | A1* | 11/2015 | Biason | B65B 39/007 53/235 |
| 2016/0107774 | A1* | 4/2016 | Kondo | B65B 39/005 53/512 |

* cited by examiner

FOOD PRODUCT PACKING APPARATUS, SYSTEM, AND METHODS THEREOF

BACKGROUND

The present disclosure relates generally to the field of organizing and packing products into containers. Packing systems can involve complex coordination of items to be packed, movement of items through stages of a packing sequence, and manual and/or automated quality control to manage the packing. Errors in such packing processes can result in longer packing times and/or waste of items, such as perishable items, that are not properly packed; various redundancies may be required to facilitate error reduction and quality control.

SUMMARY

At least one aspect relates to a packing apparatus includes a funnel including a top to receive a food product and a bottom, where a diameter of a bottom of the funnel is less than a length of the food product to orient the food product from the bottom of the funnel in a packing orientation. The packing apparatus further includes a tube connected to the bottom of the funnel, where a length of the tube is greater than or equal to half the length of the food product. The packing apparatus further includes a gate assembly connected to a bottom of the funneling assembly, where the gate assembly releases the food product in the packing orientation from an outlet of the tube.

At least one aspect relates to a packing system. The packing system includes a packing apparatus, where the packing apparatus includes a funneling assembly including a funnel and a tube connected to the funnel. The packing apparatus further includes a vibration device connected to the funneling assembly, where the vibration device vibrates the funneling assembly for the funneling assembly and the vibration device to orient the food product into a packing orientation. The packing apparatus further includes a gate assembly including a gate and an actuator for moving the gate, where the gate assembly provides the food product in the packing orientation from the packing apparatus into a container. The packing system further includes a controller to cause the actuator of the gate assembly to move the gate from a first position to block an outlet of the tube to a second position to open the outlet.

At least one aspect relates to a method for packing a food product. The method includes providing a food product into a packing apparatus for orienting the food product into a packing orientation. The method further includes vibrating the packing apparatus to orient the food product into the packing orientation. The method further includes operating a gate to release the food product from the packing apparatus and into a container. The method further includes vibrating the packing apparatus to maintain the packing orientation of the food product when released from the packing apparatus.

These and other aspects and implementations are discussed in detail below. The foregoing information and the following detailed description include illustrative examples of various aspects and implementations, and provide an overview or framework for understanding the nature and character of the claimed aspects and implementations. The drawings provide illustration and a further understanding of the various aspects and implementations, and are incorporated in and constitute a part of this specification.

BRIEF DESCRIPTION OF THE DRAWINGS

The accompanying drawings are not intended to be drawn to scale. Like reference numbers and designations in the various drawings indicate like elements. For purposes of clarity, not every component can be labeled in every drawing. In the drawings.

DETAILED DESCRIPTION

Following below are more detailed descriptions of various concepts related to, and implementations of apparatuses, systems, and methods of packing systems, such as a packing system for orienting a food product into a packing orientation for packing the food product into a container. The various concepts introduced above and discussed in greater detail below can be implemented in any of numerous ways, including in manual and/or automated packing systems using a packing apparatus.

Packaging items (e.g., products) can be performed for various products, such as foodstuffs, commodities, articles, containers, perishable or non-perishable consumables, and/or smaller packages to be stored in larger packages and/or containers, for example. Packaging processes often rely on numerous steps, components, and actors to transfer products between locations. For example, conveyors, storage points (including temperature-controlled storage, where applicable), multiple sequential and/or parallel packaging lines, and multiple workers may be required in order to transfer products into containers. In addition, it can be challenging to move products through a packaging process while maintaining proper alignment. Such requirements can increase the size footprint, energy, time, and/or material requirements for achieving target packaging performance (e.g., time, rate of items packed per time, quality control, etc.).

Apparatuses, systems, and methods in accordance with the present disclosure can provide for more efficient and/or greater packaging performance, including by providing structures for more effectively directing products into containers and/or selectively manipulating the structure(s) to guide the products into the containers. For example, the system can include a funnel structured to guide the products into an orientation to be more consistently received in containers. The funnel can be structured to reduce the likelihood of products not being received in the funnel. The system can include a tube structured to hold the products in a packing orientation for efficiently transferring the products into the container. The system can include one or more actuators (e.g., motors and/or drive systems, such as to be implemented as vibration devices and/or shaking devices) that can move (e.g., shake) the funnel and/or tube according to at least one of an amplitude or a frequency selected to orient the products for movement through the system and/or mitigate friction effects on the products, further increasing packaging performance. The system can allow for greater automation of any one or more such operations, which can allow for reduced size footprint, energy, time, and/or material requirements, such as to reduce the number of packaging lines required to achieve a target packaging rate.

Figure 1:
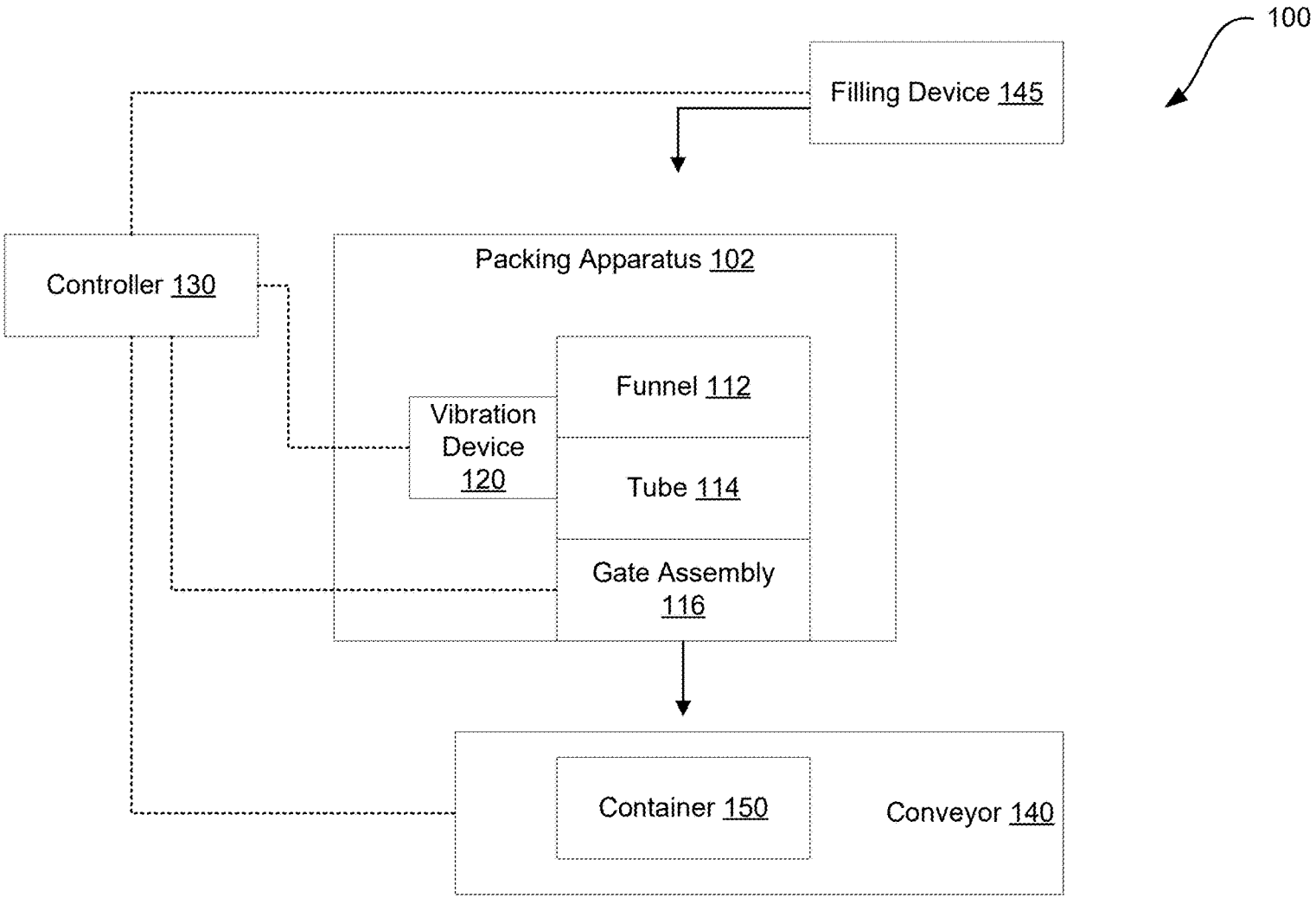
FIG. 1 is a schematic diagram of an example of a packing system.

FIG. 1 depicts an example of a system, such as a packing system 100. The packing system 100 may be used to enable the packaging of food products, among other items described herein, into containers in specific packing orientations. In brief overview, the packing system 100 includes a packing apparatus 102 for receiving a food product and organizing said food product into a packing orientation for delivery into a container 150 (e.g., a jar, a box, a tube, a bag, etc.). The packing apparatus 102 includes a funneling assembly 110 (see FIG. 2), where the funneling assembly 110 includes a funnel 112 and a tube 114 for orientating the food product into the packaging orientation. The food product may be arranged in the packaging orientation while within the tube 114. The packing apparatus 102 may further include a vibration device 120 (e.g., an actuator) connected to the funneling assembly 110, where the vibration device 120 can vibrate (e.g., shake, move) the funneling assembly 110 to assist in orienting (e.g., move, turn, minimize friction) the food product into the packing orientation. The packing apparatus 102 further includes a gate assembly 116 for providing the food product from the funneling assembly 110 into a container 150. The packing system 100 may include a conveyor 140 and/or another delivery device for positioning the container 150 underneath the packing apparatus 102 (e.g., under an outlet of the tube 114) for packing the food product into the container 150. The packing system 100 further includes a controller 130 communicably coupled to the packing apparatus 102 for controlling packing apparatus 102 (e.g., to the gate assembly 116, to the vibration device 120) to selectively deliver the food product into the container 150. The controller 130 may be communicably coupled to other components of the packing system 100 to control operation thereof. For example, the controller 130 may coordinate operation of the conveyor 140 and/or a filling device 145 (e.g., a conveyor, a gate, etc.) and/or the packing apparatus 102 to insert the food product into the funneling assembly 110 for orienting the food product into the packing orientation, position the container 150 underneath the packing apparatus 102, and open the gate assembly 116 to deliver the food product into the container 150.

The packing system 100 may be used to package various items and/or products, such as perishable or non-perishable products, fresh and/or wet food product, dry food products, commodities, and/or other products. For example, the packing system 100 may be used to package generally cylindrical and/or rectangular products, which may include but is not limited to tea bags, electrolyte powder packages, toothpaste tubes, cylindrical and/or rectangular food products (e.g. and without limitation, pickle spears), skewers, utensils, and/or cracker sleeves. The items can be cylindrical and/or rectangular, such as to have, in a three-dimensional frame of reference, a first dimension that is greater than each of a second and third dimension (e.g., length greater than width and depth; height greater than radius). Various types of containers may be used, such as boxes, jars, tubes, bags, cartons, foam structures, and/or other container types.

Referring further to FIG. 1, the container 150 can correspond to the food product being packed in the container 150. For example, for fresh and/or wet food products (e.g., pickles), the container 150 may be a jar (e.g., a sealable container). For dry products, the container 150 may be a box (e.g., cardboard box).

For example, when the packing system 100 is used to package pickle spears, where the pickle spears may be packaged into a jar (e.g., the container 150) where the pickle spears are packaged vertically within the jar (e.g., the packing orientation is a vertical arrangement of pickle spears). Multiple pickle spears may be arranged vertically within the tube 114 for packing into the jar, where the pickle spears may be released from the tube 114 and into the jar simultaneously. The pickle spears may be received by the funnel 112, where the funnel 112 begins orienting the pickle spears into the packing orientation (e.g., vertically). The pickle spears then move (e.g., via gravity) into the tube 114, where the tube 114 continues to orient the pickle spears into the packing orientation. The pickle spears are retained within the tube 114, with the pickle spears arranged vertically and adjacent to each other. The gate assembly 116 can be opened to release the pickle spears from the packing apparatus 102 and into the jar (e.g., the container 150), where the pickle spears are dropped vertically from the packing apparatus 102 so the pickle spears are retained vertically within the jar. The funnel 112 and/or the tube 114 may be vibrated by the vibration device 120 to assist in orienting the pickle spears in the packing orientation and/or to mitigate the effects of friction between the pickle spears and the funneling assembly 110. Operating the packing system 100 or one or more components thereof to pack the pickle spears may be carried out by the controller 130.

Figure 2:
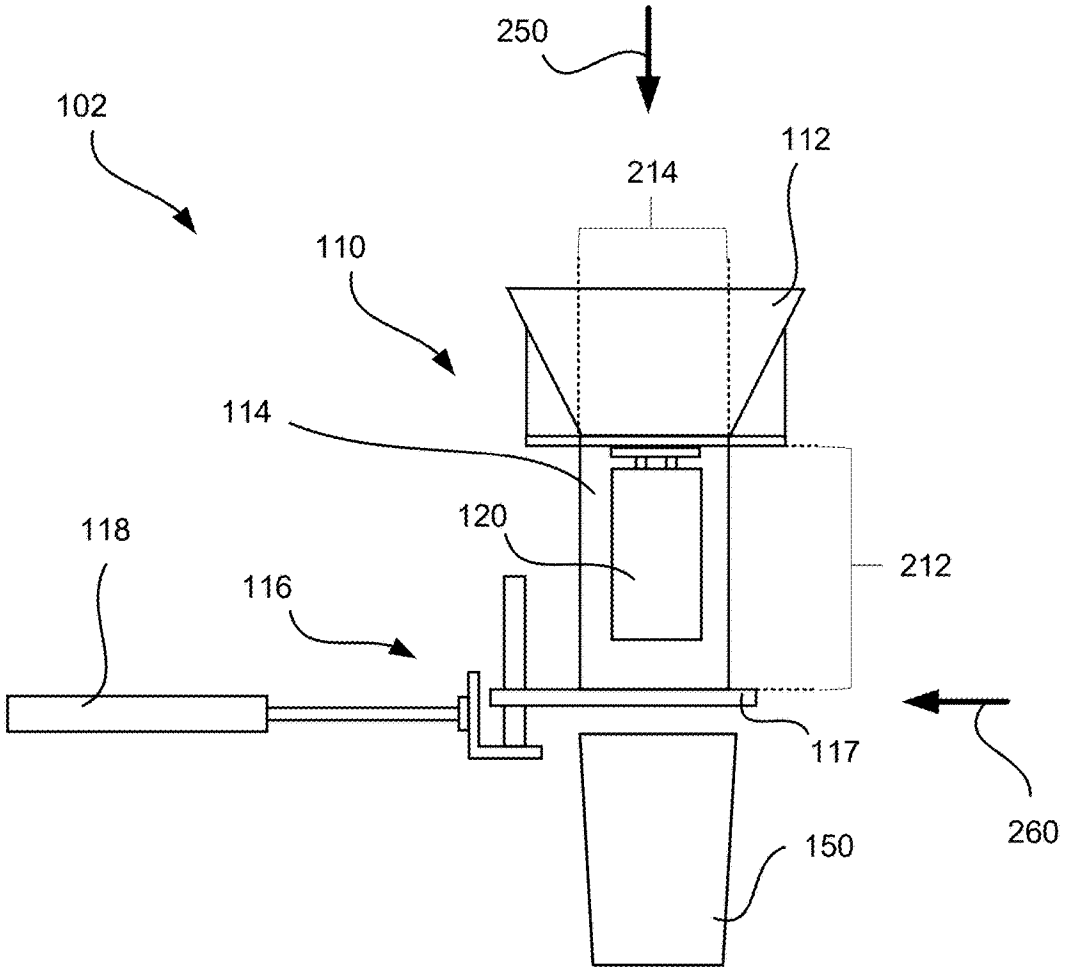
FIG. 2 is a front view of an example of a packing apparatus.
Figure 3:
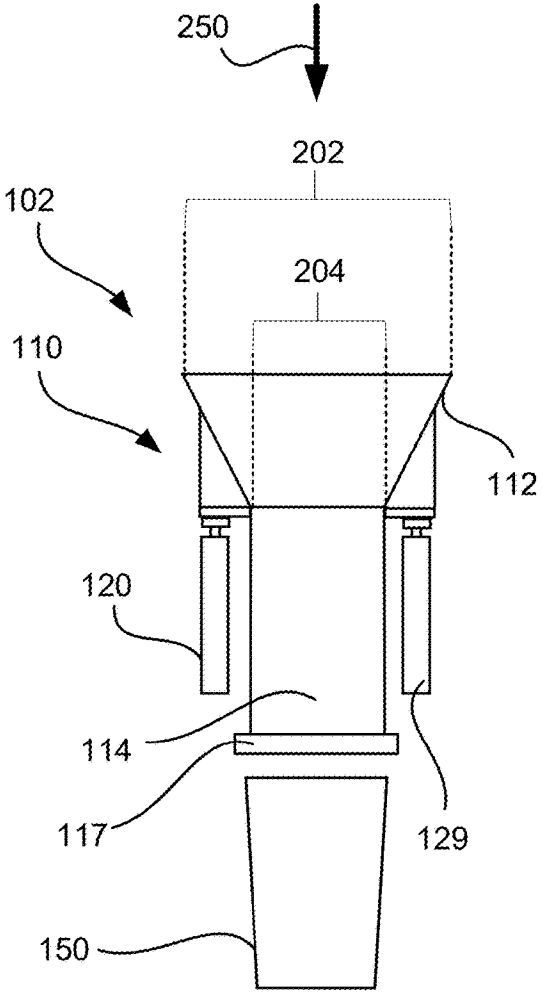
FIG. 3 is a side view of the packing apparatus of FIG. 2.

Referring to FIGS. 2-3, an implementation of the packing apparatus 102 is depicted. The packing apparatus 102 includes the funneling assembly 110 including the funnel 112 and the tube 114. The tube 114 is connected to a bottom of the funnel 112. Food product is received at a top of the funnel 112, where the funneling assembly 110 is used to orient the food product into the packing orientation for retaining the food product within the tube 114. When the food product has passed through the funnel 112 and is substantially positioned within the tube 114, the food product is oriented in the packing orientation.

An axis 250 may be defined through a center of the packing apparatus 102 (e.g., parallel to the packing apparatus 102 along a direction for packing the food product). The axis 250 may be substantially vertical (e.g., parallel with gravity). For example, the axis 250 may be perpendicular to a ground and/or floor when the packing apparatus 102 is positioned thereon. Because the axis 250 may be substantially vertical, the food product may move through the packing apparatus 102 and/or the packing system via gravity (e.g., along the axis 250). The packing orientation may be defined by the axis 250, where the food product is oriented substantially parallel to the axis 250 when in the packing orientation. For example, the packing orientation may be vertical and/or substantially vertical. Substantially vertical may be defined where the food product is oriented at least partially vertically and within +/−5, 10, or 15 or more degrees from parallel with the axis 250 and/or with gravity. A plurality of food products may be arranged in the packing orientation, where the food products are arranged adjacent to each other and substantially parallel to the axis 250 (e.g., to pack the food products adjacent to each other in the container 150). The packing orientation may be an optimal orientation for packing the food product into the container 150 (e.g., to fit the most products into the container 150, for providing easy access to the product within the container 150, for aesthetic, etc.). In some implementations, one or more components of the packing apparatus 102 can be arranged such that the axis 250 (e.g., as a longitudinal axis of the funnel 112 and/or tube 114) is offset from a vertical/gravity-oriented axis; gravity may still be used to at least partially facilitate moving food products through the packing apparatus 102, including, for example, to allow for vertical or substantially vertical orientation of the food product.

The funnel 112 may be shaped as a conical structure, such as a conical, frustroconical, or trapezoidal structure. The funnel 112 can be inverted, such as to have a greater extent at a side further from the gate 117 than a side closer to the gate 117. A first diameter 202 at the top of the funnel 112

(e.g., a top diameter, a large diameter) may be greater than or equal to a length of the food product. The first diameter 202 of the funnel 112 may be measured at the top (e.g., a mouth) of the funnel 112 where the food product is received by the packing apparatus 102, where the first diameter 202 is greater than or equal to the largest dimension of the food product to capture the food product into the packing apparatus 102, thereby avoiding spillage of the food product.

The funnel 112 includes a second diameter 204 at the bottom of the funnel 112 (e.g., a bottom diameter, a small diameter). For example, the second diameter 204 may be smaller than the first diameter 202. The second diameter 204 is dimensioned where the food product cannot move through the funnel 112 when the length of the food product is substantially perpendicular to the axis 250 (e.g., lengthwise), so thereby the funnel 112 can at least partially orient (e.g., rotate, move) the food product into the packing orientation (e.g., substantially parallel to the axis 250). For example, the second diameter 204 is less than the length of the food product. The second diameter 204 may be less than or equal to half the length of the food product. Because the second diameter 204 is less than the length of the food product, the food product cannot pass the funnel 112 lengthwise, so the funnel 112 orients the food product to pass through the funnel 112 with the food product becoming oriented substantially parallel to the axis 250. In some implementations, the length of the food product may be a height, a width, and/or measurable dimension of the food product, such that the funnel 112 may be sized (e.g., the first diameter 202, the second diameter 204) according to desired dimensions of the food product for producing the packing orientation. For example, the funnel 112 is dimensioned and/or shaped so the food product may be turned to move through the funnel 112 with the food product oriented vertically, where vertically may refer to the longest dimension of the food product aligned substantially in parallel with the axis 250 (e.g., and/or with gravity). In some implementations, the funnel 112 may be otherwise shaped, where the first diameter 202 of the funnel 112 may be another dimension, such as a width and/or a length across the top of the funnel 112.

The tube 114 is connected to the funnel 112 at a bottom end of the funnel 112. The tube 114 may be connected to the funnel 112 by one or more of welding, adhesives, fasteners, or additional coupling mechanisms. The tube 114 orients the food product into the packing orientation (e.g., continue orienting the food product as the food product moves past the funnel 112). For example, if the food product is not substantially parallel to the axis 250 as it passes through the funnel 112 (e.g., moving at an angle relative to the axis 250), the tube 114 is used to continue to orient (e.g., finish orienting) the food product to be substantially parallel to the axis 250 (e.g., in the packing orientation). The tube 114 retains the food product in the packing orientation for delivering the food product into the container 150. The structuring of the funnel 112 and/or tube 114 can allow for a greater likelihood of alignment of the food product into the packing orientation, which can allow for greater automation of the packing process and/or reduced errors for correct packing of items.

The tube 114 has a diameter 214 substantially equal to the second diameter 204 of the funnel 112. The tube 114 is generally cylindrical, with a cavity extending through the tube 114 to connect to the funnel 112 and retain the food product within the cavity (e.g., within the tube 114). The tube 114 includes an outlet for the food product to be released from the tube 114. For example, the food product is received at a first end (e.g., a top) of the tube 114 from the funnel 112, the tube 114 retains the food product within the cavity in the packing orientation, and the food product leaves the tube 114 from the outlet at a second end (e.g., a bottom) of the tube 114. The tube 114 is positioned along and/or parallel to the axis 250, where the cavity extends through the tube 114 along the axis 250, and the outlet releases the food product along and/or parallel to the axis 250. In some implementations, the diameter 214 of the tube 114 may be another dimension, such as a width and/or a length across the tube 114, for example, when the funnel 112 and/or the tube 114 are shaped differently.

A height 212 of the tube 114 is dimensioned so the food product is retained within the tube 114 in the packing orientation for delivery into the container 150. For example, the height 212 of the tube 114 may be greater than or equal to 1, 2, 3, or 4 or more times the length of the food product. The height 212 of the tube 114 may also be dimensioned where the food product may partially extend into the funnel 112 when oriented in the packing orientation within the tube 114, thereby assisting in additional food product being oriented and moving into the tube 114 (e.g., so the food products don't accidentally stack on top of each other in the tube 114 instead of orienting adjacent to each other for packaging). For example, the height 212 of the tube 114 may be greater than or equal to half the length of the food product.

The packing apparatus 102 can include the gate assembly 116 positioned below the funneling assembly 110, with the gate assembly 116 selectively allowing the food product to be released from the packing apparatus 102 and packaged into the container 150. The gate assembly 116 includes a gate 117 and an actuator 118 (e.g., a motor), where the actuator 118 can move (e.g., open, close) the gate 117. When the gate 117 is in a first position (e.g., a closed position), the gate 117 covers (e.g., blocks) the outlet of the tube 114 to substantially prevent the food product from moving out of (e.g., leaking, escaping, spilling, etc.) the tube 114. When the gate 117 is in a second position (e.g., an open position), the gate 117 opens the outlet of the tube 114 to release (e.g., via gravity) the food product. Once the food product is removed from the tube 114, the gate 117 is returned to the first position (e.g. closed), so additional food product (e.g., another batch) can be moved into the tube 114.

The gate assembly 116 may be connected to the funneling assembly 110 (e.g., to the tube 114) using welding, fasteners, adhesives, and/or other coupling mechanism. The gate 117 may form a seal and/or a covering with the tube 114 for retaining the food product within the tube 114 when the gate 117 is closed. For example, the gate 117 may contact the bottom of the tube 114 to block the outlet of the tube 114, where the food product may partially rest on the gate 117 when retained within the tube 114. The actuator 118 (e.g., a motor and/or linear actuator) may be mounted to the packing apparatus 102. The actuator 118 may be mounted on a support member positioned near the packing apparatus 102.

The gate 117 may be a sliding door, where the actuator 118 slides the gate 117 away from and/or covering the tube 114. An axis 260 may be defined substantially perpendicular to the packing apparatus 102. For example, the axis 260 may be perpendicular to the axis 250. The gate 117 may slide along and/or parallel to the axis 260 to open or close the tube 114. In some implementations, the gate 117 may rotate away from the tube 114 (e.g., rotate around the axis 260). The gate 117 may be a trapdoor, where the gate 117 includes a plurality of portions hinged around the tube 114, where the actuator 118 rotates the plurality of portions away from the tube 114 to open the gate 117.

The packing apparatus 102 may further include the vibration device 120 connected to the funneling assembly 110. The vibration device 120 may be connected to the funnel 112 and/or the tube 114. The vibration device 120 may vibrate the funneling assembly 110 in its entirety (e.g., both the funnel 112 and the tube 114) or vibrate the funnel 112 and the tube 114 separately. The vibration device 120 vibrates (e.g., shakes) the funnel 112 and/or the tube 114 vibrating (e.g., shaking) to assist in orienting the food product into the packing orientation. For example, the vibration device 120 can operate (e.g., responsive to control from controller 130) in a manner that allows for mitigating frictional effects on the food product while transferred through the funneling assembly 110 while avoiding excessive movement of the food product that could result in food product moving too far out of the packing orientation and/or being shaken out of the funneling assembly 110. As described further herein, the vibration device 120 can include any one or more motors, actuators, pistons, springs, and/or dampers to facilitate targeted movement of one or more components of the packing apparatus 102, including according to at least one of a target amplitude (e.g., in distance) or target frequency (e.g., in movement per time unit) to achieve appropriate facilitation of movement of the food products through and out of the packing apparatus 102.

The vibration device 120 may vibrate the funneling assembly 110 as the food product is received by the funnel 112 to orient the food product into the packing orientation and/or move the food product into the tube 114. For example, vibrating the funnel 112 may assist in turning the food product vertical to pass through the funnel 112 for orientation within the tube 114. The vibration device 120 may vibrate the funneling assembly 110 while the gate assembly 116 releases the food product from the outlet of the tube 114. During operation of the packing apparatus 102, the food product may become stuck to a surface of the funnel 112 during orientation, struggle to orient correctly through the funnel 112 (e.g., turn), and/or become stuck to a surface within the tube 114 when being released by the gate 117 and thereby damaging the packing orientation. For example, the food product sticking to the tube 114 may allow the food product and/or another food product adjacent to the food product to turn and not be oriented substantially vertical when released from the tube 114, thereby breaking the packing orientation. Vibration of the funneling assembly 110 assists in moving the food product through the packing apparatus 102 for orienting said food product into the packing orientation, as well as mitigating friction effects on the food product during orientation by the funneling assembly 110.

In some implementations, the packing apparatus 102 may include multiple vibration devices. The packing apparatus 102 may include 1, 2, 3, or 4 or more vibration devices. In some implementations, the vibration devices may be connected to different components and/or aspects of the packing system 100 for separately vibrating said components and/or aspects. For example, the packing apparatus 102 may include a second vibration device 129, where the vibration device 120 is connected to the funnel 112 and the second vibration device 129 is connected to the tube 114. In some implementations, the vibration devices may be positioned opposite each other and/or evenly spaced apart to create a balanced (e.g., even) vibration for the funneling assembly 110. As depicted in FIG. 3, the second vibration device 129 is positioned opposite the vibration device 120 on the funneling assembly 110 for balanced vibration of the funneling assembly 110. For example, the second vibration device 129 may be positioned on the funneling assembly 110 opposite the vibration device 120 relative to the axis 250 and/or a plane extending through the axis 250. The second vibration device 129 is positioned equidistant from the axis 250 and/or the plane extending through the axis 250 relative to the vibration device 120 to create a balanced vibration for the funneling assembly 110.

The vibration device 120 may include an actuator to move the vibration device 120 and/or a component thereof (e.g., a spring), thereby creating vibration. The vibration device 120 can vibrate in a substantially vertical direction (e.g., along and/or parallel to the axis 250). The vibration device 120 may vibrate in a partially vertical direction (e.g., at an angle). The vibration device 120 vibrates with an amplitude and a frequency. The vibration device 120 may vibrate with a desired amplitude and a desired frequency, which may be set values, where the desired amplitude and the desired frequency are based at least in part on the properties (e.g., size, weight) of the food product. For example, the vibration device 120 can vibrate with the amplitude and/or the frequency calculated as a ratio of a property of the food product.

The vibration device 120 can vibrate with the amplitude of at least ½ inch. The vibration device 120 may vibrate with the amplitude of at least 1, 2, 3, or 4 or more inches. The vibration device 120 may vibrate with the amplitude between ½ inch to 3 inches. The vibration device 120 can vibrate with the frequency of at least 1 vibration (e.g., stroke) per second. The vibration device 120 may vibrate with the frequency of at least 1, 2, 3, or 4 vibrations per second. The vibration device 120 may vibrate at the frequency between 1 to 5 vibrations per second. The amplitude and/or the frequency of the vibration device 120 may vary during operation. The vibration device 120 may vibrate continuously during operation of the packing system 100. The vibration device 120 may vibrate intermittently (e.g., be turned on and off) during operation of the packing system 100, where the vibration device 120 operates at specific times and/or concurrently with specific events (e.g., receiving the food product in the funnel 112, releasing the food product from the tube 114, etc.).

The packing system 100 includes the controller 130, where the controller 130 is communicably coupled to one or more components of the packing system 100, where the controller 130 coordinates operation of one or more of the filling device 145, the vibration device 120, the gate assembly 116, and/or the conveyor to receive the food product into the funnel 112 of the packing apparatus 102, orient the food product into the packing orientation within the tube 114 using the funneling assembly 110 and/or the vibration device 120, release the food product from the tube 114 using the gate assembly 116 into the container 150. The controller 130 can include one or more processors and memory. The processor may be a general purpose or specific purpose processor, an application specific integrated circuit (ASIC), one or more field programmable gate arrays (FPGAs), a group of processing components, or other suitable processing components. The processor may be configured to execute computer code or instructions stored in memory (e.g., fuzzy logic, etc.) or received from other computer readable media (e.g., CDROM, network storage, a remote server, etc.) to perform one or more of the processes described herein.

The memory may include one or more data storage devices (e.g., memory units, memory devices, computer-readable storage media, etc.) configured to store data, computer code, executable instructions, or other forms of computer-readable information. The memory may include random access memory (RAM), read-only memory (ROM), hard drive storage, temporary storage, non-volatile memory, flash memory, optical memory, or any other suitable memory for storing software objects and/or computer instructions. The processor can be implemented as a hardware processor including a Central Processing Unit (CPU), an Application-Specific Integrated Circuit (ASIC), an Application-Specific Instruction-Set Processor (ASIP), a Graphics Processing Unit (GPU), a Physics Processing Unit (PPU), a Digital Signal Processor (DSP), a Field Programmable Gate Array (FPGA), a Programmable Logic Device (PLD), a Controller, a Microcontroller unit, a Processor, a Microprocessor, an ARM, or the like, or any combination thereof. The memory may include database components, object code components, script components, or any other type of information structure for supporting the various activities and information structures described in the present disclosure. The memory can include various modules (e.g., circuits, engines) for completing processes described herein. The controller 130 can include one or more of various electronic control hardware devices, for example and without limitation, a microcontroller, an application specific integrated circuit (ASIC), a field programmable gate array (FPGA), or a programmable controller, such as a programmable logic controller (PLC).

The controller 130 can include one or more input and/or output ports. The input ports can receive input signals from any of various current, voltage, and/or resistance-based sensors. The output ports can include any one or more digital and/or analog outputs. The controller 130 can include or be coupled with a communications circuit to communicate using one or more communications protocols (e.g., parameters, techniques), including, for example, BACNet (e.g., multiple spanning tree protocol (MSTP) and/or internet protocol (IP)) and/or MODBUS. The communications circuit can include wired communications connectors, such as Ethernet connectors. The communications circuit can include wireless communications connectors.

The controller 130 can operate the packing system 100 autonomously to pack the food product into the container 150. In some implementations, the packing system 100 may include a user device, where the user device is communicably coupled to the controller 130. The user device can provide for manual input into operating the packing system 100. For example, the user device may be used to adjust the vibration (e.g., amplitude, frequency) of the vibration device 120. Other aspects for operating the packing system 100 may be controlled using the user device. The controller 130 can control operation of component(s) of the packing system 100 according to one or more schedules, parameters or characteristics of the items to be packed, detected sensor data (e.g., from one or more scales or weight sensors of the filling device 145), user inputs, or various combinations thereof.

The controller is communicably coupled to the packing apparatus 102 and/or components thereof. For example, the controller 130 can control the vibration of the funneling assembly 110 (e.g., by providing a control signal to one or more vibration devices 120) to orient and maintain the food product vertically during operation of the packing system 100 to pack the food product vertically into the container 150. The controller 130 is communicably coupled to the gate assembly 116 to cause operation of the gate assembly 116 as described herein. For example, the controller 130 causes the actuator 118 to move the gate 117 from the first position to block the outlet of the tube 114 to the second position to open the outlet of the tube 114 and release the food product. The controller 130 is communicably coupled to the vibration device 120 to cause operation of the vibration device 120 as described herein. The controller 130 may cause the vibration device 120 to vibrate the funneling assembly 110 while the gate assembly 116 operates to open the gate 117 and release the food product from the outlet of the tube 114. Vibrating the funneling assembly 110 may occur concurrently with the controller 130 operating the gate assembly 116 to release the food product from the tube 114 (e.g., the controller 130 causes both operations to occur simultaneously). Vibrating the funneling assembly 110 may occur in response to the controller 130 operating the gate assembly 116 to release the food product from the tube 114 (e.g., the controller 130 receives a signal from the gate assembly 116 indicative of the gate 117 being opened, where the controller 130 then operates the vibration device 120). The controller 130 causes the vibration device 120 to vibrate the funneling assembly 110 for orienting the food product into the packing orientation. The controller 130 may operate the vibration device 120 to vibrate the funneling assembly 110 simultaneously to receiving the food product into the funnel 112 (e.g., the controller 130 causes the vibration device 120 to vibrate during receipt of the food product into the funnel 112).

In some implementations, the packing system 100 includes one or more input devices (e.g., sensors), where the input devices are communicably coupled to the controller 130 to send sensor data to the controller 130 for operating aspects of the packing system 100. For example, the one or more input devices may detect the container 150 positioned underneath the packing apparatus 102 (e.g., under the outlet of the tube 114), where the controller 130 then operates the gate assembly 116 to release the food product from the tube 114 and into the container 150. For another example, the one or more input devices may detect the food product in the packing orientation within the tube 114, where the controller 130 then operates the gate assembly 116 to release the food product from the tube 114 and into the container 150. The one or more input devices may detect the food product being inserted into the funnel 112, where the controller 130 then operates the vibration device 120 to vibrate the funneling assembly 110 to orient the food product into the packing orientation.

The packing system 100 may include the filling device 145 to provide the food product into the funnel 112 of the funneling assembly 110. The filling device 145 may be positioned above and/or adjacent to the top of the funnel 112. The controller 130 may be communicably coupled to the filling device 145 and/or to a controller thereof, where the controller 130 coordinates operation of the packing apparatus 102 with the filling device 145 providing the food product into the funnel 112. For example, the controller 130 may operate the vibration device 120 to vibrate the funneling assembly 110 simultaneously to receiving the food product into the funnel 112 (e.g., the controller 130 causes the vibration device 120 to vibrate simultaneously with the filling device 145 providing the food product to the funnel 112). The controller 130 may receive a signal indicative of the filling device 145 transferring the food product into the funnel 112. For example, when the filling device 145 operates to transfer the food product into the packing apparatus 102, the controller 130 may cause the vibration device 120 to vibrate the funneling assembly 110 to orient the food product into the packing orientation (e.g., the controller 130 receives a signal indicative of the filling device 145 providing the food product to the funnel 112, where the controller 130 then operates the vibration device 120) . . . . In some implementations, the controller 130 may receive sensor data from the one or more input devices to coordinate operation of the filling device 145 and the packing apparatus 102.

The filling device 145 may include a sensor, e.g., a scale and/or other measuring device for detecting and/or measuring an amount of the food product to be packed within the container 150. For example, the filling device 145 provide an amount of the food product to be packed into the container 150 (e.g., a batch, a portion) to the packing apparatus 102. The controller 130 of the packing system 100 may be communicably coupled to the filling device 145 to determine the batch of the food product to be packed by the packing apparatus 102. For example, the controller may compare a reading (e.g., measurement) of the scale of the filling device 145 to a threshold value for packing the food product, and cause the filling device 145 to transfer the food product into the funnel 112 of the packing apparatus 102. The filling device 145 may use the scale to measure out a batch of the food product for packing within the container 150. The controller 130 then causes the filling device 145 to move the batch of the food product into the funnel 112.

The packing system 100 may further include the conveyor 140 to position the container 150 underneath the packing apparatus 102. The container 150 is positioned underneath the outlet of the tube 114 to receive the food product. Once the food product is inserted into the container 150, the conveyor 140 may move the container 150 away from the packing apparatus 102 (e.g., for further processing, further packaging into a larger container or onto a pallet, to be shipped, etc.). The conveyor 140 may correspond in size and/or configuration according to the container 150, where the conveyor 140 retains the container 150 during operation of the packing system 100.

The controller 130 may be communicably coupled to the conveyor 140 and/or to a controller thereof, to cause the conveyor 140 to provide (e.g., via an actuator powering the conveyor 140) the container 150 underneath the outlet of the tube 114. The controller 130 may be communicably coupled to the conveyor 140 and/or to a controller thereof, where the controller 130 coordinates operation of the packing apparatus 102 with the conveyor 140 to provide the food product into the container 150. For example, the controller 130 may cause the conveyor 140 to move the container 150 and/or the controller 130 may receive a signal from the conveyor 140, and/or a controller thereof, indicating that the container 150 is positioned underneath the outlet of the tube 114, where the controller 130 may then cause the gate assembly 116 to open the gate 117 to release the food product into the container 150. The controller 130 may cause the vibration device 120 to vibrate the tube 114 when releasing the food product into the container 150 to maintain the packing orientation of the food product. In some implementations, the controller 130 may receive sensor data from the one or more input devices to coordinate operation of the conveyor 140 and the packing apparatus 102.

The container 150 may be vibrated by a vibration device and/or another vibration device (e.g., a second vibration device, a third vibration device) to maintain the packing alignment of the food product when the food product is inserted into the container 150 from the packing apparatus 102. The vibration device may be connected to the conveyor 140. The vibration device may extend over the conveyor 140 and connect to (e.g., a robotic arm) the container 150. The controller 130 may be communicably coupled to the vibration device for vibrating the container 150. The controller 130 may coordinate vibrating the container 150 with operating the gate assembly 116 and/or vibrating the tube 114 using the vibration device 120 to provide the food product into the container 150 in the packing orientation.

In some implementations, the controller 130 may control the filling device 145, the vibration device 120, the gate assembly 116, and/or the conveyor 140 in a set order of operations (e.g., on a timed and/or set schedule) to coordinate the packing of the food product into the container 150. For example, the controller 130 may send signals to operate each component of the packing system 100. In some implementations, the controller 130 may control the filling device 145, the vibration device 120, the gate assembly 116, and/or the conveyor 140 based on receiving signals from said components, where the controller 130 controls the components accordingly (e.g., controlling in response to detection using one or more input devices).

Figure 4:
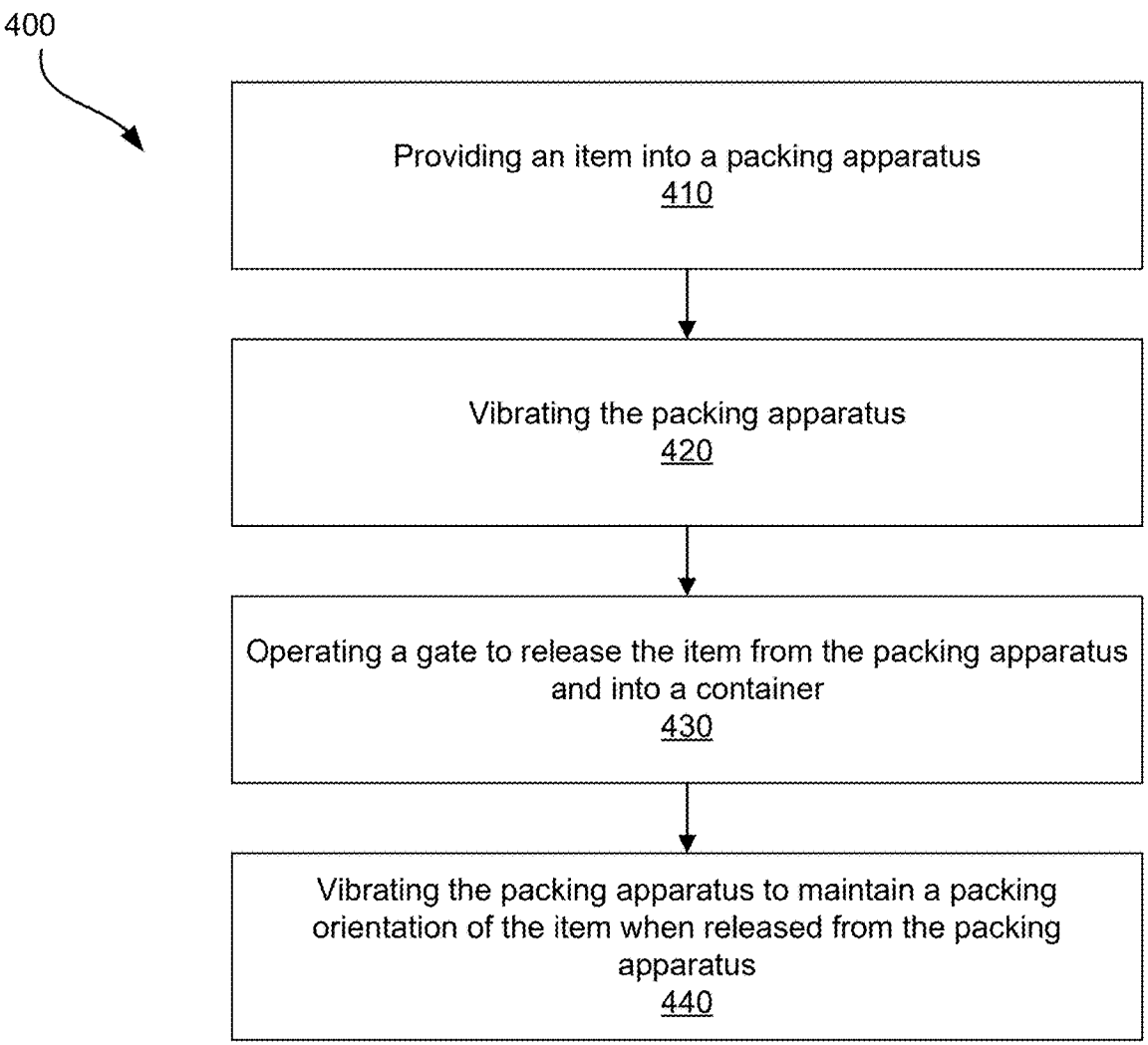
FIG. 4 is a flow diagram of a method for packing a food product.

Referring to FIG. 4, a method 400 for packing a food product is depicted. The method 400 can be performed using an implementation of the packing system 100, as described herein, including for food products or non-food products. The method 400 can be performed to increase packaging performance (e.g., efficiency, automation) of food products into containers. The method 400 may include additional, fewer, and/or a different order of method steps. The method 400 may be performed with method steps performed concurrently.

At 410, a food product may be provided to a packing apparatus for orienting the food product into a packing orientation. For example, the food product may be provided into a funnel for orienting the food product into a packing orientation within a tube connected to a bottom of the funnel. The food product may be provided by a filling device. The funnel can at least partially orient the food product to move said food product into the tube, where the tube orients and/or finishes orienting the food product into the packing orientation. The tube at least partially retains the food product in the packing orientation.

At 420, the packing apparatus may be vibrated to orient and/or assist in orienting the food product into the packing orientation. For example, the funnel may be vibrated to orient the food product into the packing orientation. The tube may also be vibrated. A vibration device may be operated to vibrate the funnel and/or the tube for packing the food product into the container. Vibrating the funnel assists in orienting the food product into the packing orientation (e.g., by mitigating friction effects on the food product).

At 430, a gate may be opened to release the food product from the packing apparatus and into a container. For example, the gate may be operated (e.g., opened) to release the food product into a container positioned below an outlet of the tube. The gate may block the outlet of the tube (e.g., the gate is closed) when the food product is being oriented into the packing orientation. The gate being closed also provides for the food product to be maintained within the packing orientation within the tube. Opening the gate releases the food product (e.g., via gravity) for packing into the container.

At 440, the packing apparatus may be vibrated to maintain the packing orientation of the food product when released from the packing apparatus. For example, the tube may be vibrated to maintain the packing orientation of the food product when released from the outlet of the tube and into the container. The vibration device and/or a second vibration device may be operated to vibrate the tube when the gate is opened for packing the food product into the container. Vibrating the tube can maintain the food product in the packing orientation by mitigating friction effects between the food product and the tube (e.g., the food product may stick to the tube).

In some implementations, a conveyor may be operated to provide the container underneath the outlet of the tube for packing the food product into the container. The container may be vibrated to maintain the packing orientation of the food product when the food product is inserted (e.g., packed) into the container. Another vibration device may be used to vibrate the container.

As noted above, any of various apparatuses, systems, and methods described herein can be implemented for any of various packing and/or packaging applications. This can include, for example and without limitation, packing food or non-food products, including at room temperature, in dry or at least partially wet form, and in pre-packaged items (e.g., packets, etc.) or for direct packing of items. For example, a plurality of items (for example and without limitation, cylindrical and/or rectangular products, which may include tea bags, electrolyte powder packages, toothpaste tubes, cylindrical and/or rectangular food products (e.g. and without limitation, pickle spears), skewers, utensils, and/or cracker sleeves) can be received in a funnel. The funnel can have a first end and a second end opposite the first end. The first end can have a greater extent than the second end, such as to have a greater width or diameter than the second end. The first end can have an extent that is at least one half a length of the item; this can allow the funnel to effectively receive the items and/or initiate any adjustment of the items into a packing orientation, such as a vertical orientation. A tube can be coupled with the second end, and can have an extent equivalent to an extent of the second end. The tube can have a length (e.g., in a vertical direction corresponding to the packing orientation) greater than or equal to half the length of the item. The items can move (e.g., based on gravity and/or other forces on the items) from the funnel through the tube. A gate can be provided to selectively permit movement of items out of the tube, such as to be moved from a closed state where positioned between the tube and a container to an open state to at least partially open a path between the tube and the container. In some implementations, one or more vibration devices can move, e.g., vibrate, at least one component of the system, such as to vibrate the funnel and/or tube; the vibration can be performed to move the at least one component according to at least one of an amplitude or a frequency targeted to facilitate movement of the items through the system while mitigating or avoiding likelihood of over-rotation (e.g., more than 90 degrees from the packing orientation) of items. The components of the system and/or the operation of the vibration device(s) can be selected to facilitate, given at least one of a length, a length-to-width ratio, or a weight of the items, orienting the items into a packing orientation during movement of the items through the system and/or to mitigate movement of the items out of the packing orientation, including to align the items into a vertical orientation (e.g., such that a longest dimension of the items is vertical) in series and/or in parallel for delivery into the container in a vertical orientation.

Having now described some illustrative implementations, it is apparent that the foregoing is illustrative and not limiting, having been presented by way of example. In particular, although many of the examples presented herein involve specific combinations of method acts or system elements, those acts and those elements can be combined in other ways to accomplish the same objectives. Acts, elements and features discussed in connection with one implementation are not intended to be excluded from a similar role in other implementations or implementations.

The phraseology and terminology used herein is for the purpose of description and should not be regarded as limiting. The use of "including" "comprising" "having" "containing" "involving" "characterized by" "characterized in that" and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Any references to implementations or elements or acts of the systems and methods herein referred to in the singular can also embrace implementations including a plurality of these elements, and any references in plural to any implementation or element or act herein can also embrace implementations including only a single element. References in the singular or plural form are not intended to limit the presently disclosed systems or methods, their components, acts, or elements to single or plural configurations. References to any act or element being based on any information, act or element can include implementations where the act or element is based at least in part on any information, act, or element.

Any implementation disclosed herein can be combined with any other implementation or embodiment, and references to "an implementation," "some implementations," "one implementation" or the like are not necessarily mutually exclusive and are intended to indicate that a particular feature, structure, or characteristic described in connection with the implementation can be included in at least one implementation or embodiment. Such terms as used herein are not necessarily all referring to the same implementation. Any implementation can be combined with any other implementation, inclusively or exclusively, in any manner consistent with the aspects and implementations disclosed herein.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

Systems and methods described herein may be embodied in other specific forms without departing from the characteristics thereof. Further relative parallel, perpendicular, vertical or other positioning or orientation descriptions include variations within +/−10% or +/−10 degrees of pure vertical, parallel or perpendicular positioning. References to "approximately," "about" "substantially" or other terms of degree include variations of +/−10% from the given measurement, unit, or range unless explicitly indicated otherwise. Coupled elements can be electrically, mechanically, or physically coupled with one another directly or with intervening elements. Scope of the systems and methods described herein is thus indicated by the appended claims, rather than the foregoing description, and changes that come within the meaning and range of equivalency of the claims are embraced therein.

The term "coupled" and variations thereof includes the joining of two members directly or indirectly to one another. Such joining may be stationary (e.g., permanent or fixed) or moveable (e.g., removable or releasable). Such joining may be achieved with the two members coupled directly with or to each other, with the two members coupled with each other using a separate intervening member and any additional intermediate members coupled with one another, or with the two members coupled with each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

Modifications of described elements and acts such as variations in sizes, dimensions, structures, shapes and proportions of the various elements, values of parameters, mounting arrangements, use of materials, colors, orientations can occur without materially departing from the teachings and advantages of the subject matter disclosed herein. For example, elements shown as integrally formed can be constructed of multiple parts or elements, the position of elements can be reversed or otherwise varied, and the nature or number of discrete elements or positions can be altered or varied. Other substitutions, modifications, changes and omissions can also be made in the design, operating conditions and arrangement of the disclosed elements and operations without departing from the scope of the present disclosure.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

What is claimed is:

1. A packing apparatus comprising:

a funnel comprising a top to receive a food product and a bottom, wherein a diameter of a bottom of the funnel is less than a length of the food product to orient the food product from the bottom of the funnel to a packing orientation;

a tube connected to the bottom of the funnel, wherein a length of the tube is greater than or equal to half the length of the food product;

a vibration device connected to the funnel and extending adjacent to the tube, the vibration device to vibrate the funnel in a substantially vertical direction; and a gate assembly connected to a bottom of the tube, wherein the gate assembly is to release the food product from an outlet of the tube.

2. The packing apparatus of claim 1, wherein the vibration device vibrates the funnel at an amplitude of at least ½ inch.

3. The packing apparatus of claim 2, wherein the vibration device is configured to vibrate with an amplitude of ½ inch to 3 inches.

4. The packing apparatus of claim 2, wherein the vibration device or a second vibration device vibrate the tube when the gate assembly releases the food product from the packing apparatus.

5. The packing apparatus of claim 1, wherein the vibration device is configured to vibrate the funnel at a frequency of 1 to 5 vibrations per second.

6. The packing apparatus of claim 1, wherein a diameter of the tube is equal to the diameter of the bottom of the funnel.

7. The packing apparatus of claim 1, wherein the gate assembly comprises a gate and an actuator connected to the gate for moving the gate from a first position to block an outlet of the tube to a second position to open the outlet.

8. A packing system comprising:

a packing apparatus comprising:

a funneling assembly comprising a funnel and a tube connected to the funnel, the packing apparatus defining an axis through the funnel and the tube, the packing apparatus is structured such that the axis is vertical;

a vibration device connected to the funneling assembly, wherein the vibration device vibrates the funneling assembly in a direction substantially parallel with the axis to orient a food product into a packing orientation that is substantially parallel with the axis; and a gate assembly comprising a gate and an actuator for moving the gate, wherein the gate assembly provides the food product in the packing orientation from the packing apparatus into a container; and a controller to cause the actuator of the gate assembly to move the gate from a first position to block an outlet of the tube to a second position to open the outlet.

9. The packing system of claim 8, wherein the controller causes the vibration device to vibrate the funneling assembly during receipt of the food product by the funnel.

10. The packing system of claim 8, wherein the controller causes the vibration device to vibrate the funneling assembly while the gate is opened to provide the food product into the container.

11. The packing system of claim 8, wherein the controller causes the vibration device to vibrate in a vertical direction.

12. The packing system of claim 8, wherein the vibration device vibrates with an amplitude of ½ inch to 3 inches.

13. The packing system of claim 8, wherein the vibration device vibrates at a frequency of 1 to 5 vibrations per second.

14. The packing system of claim 8 further comprising a second vibration device to vibrate the container when the container receives the food product.

15. The packing system of claim 8, wherein the packing system further comprises a conveyor to position the container underneath the outlet of the tube of the packing apparatus.

16. The packing system of claim 8 further comprising a filling device to provide the food product into the funnel, wherein the filling device comprises a scale for measuring the food product for packing within the container, and wherein the controller:

compares a reading of the scale to a threshold value for packing the food product; and causes the filling device to transfer the food product into the funnel.

17. The packing system of claim 8, wherein the packing orientation is vertical, and wherein the food product is vertically packaged within the container.

18. The packing system of claim 8, wherein the vibration device is positioned at least partially adjacent and substantially parallel to the tube.

19. A method comprising:

providing a food product into a funnel for orienting the food product into a packing orientation within a tube connected to a bottom of the funnel;

operating a vibration device to vibrate the funnel and the tube in a vertical direction for packing the food product into a container;

operating a gate to release the food product into a container positioned below an outlet of the tube; and vibrating the tube to maintain the packing orientation of the food product when released from the outlet of the tube and into the container.

20. The method of claim 19, wherein the method further comprises vibrating the container to maintain the packing orientation of the food product when the food product is inserted into the container.

* * * * *